US005442387A

United States Patent [19]

Loofbourow et al.

[11] Patent Number: 5,442,387

[45] Date of Patent: * Aug. 15, 1995

[54] APPARATUS FOR SUPPLYING PHASE CHANGE INK TO AN INK JET PRINTER

[75] Inventors: Donald I. Loofbourow, Lake Oswego; Richard G. Chambers, Portland, both of Oreg.

[73] Assignee: Tektronix, Inc., Wilsonville, Oreg.

[ * ] Notice: The portion of the term of this patent subsequent to Jun. 29, 2010 has been disclaimed.

[21] Appl. No.: 82,209

[22] Filed: Jun. 23, 1993

Related U.S. Application Data

[63] Continuation of Ser. No. 716,567, Jun. 17, 1991, Pat. No. 5,223,860.

[51] Int. Cl.[6] ..... B41J 2/175

[52] U.S. Cl. ..... 347/88

[58] Field of Search ..... 346/140 R; 347/85, 88

[56] References Cited

U.S. PATENT DOCUMENTS

| | | | |
|---|---|---|---|
| 4,490,731 | 12/1984 | Vaught | 346/140 |
| 4,593,292 | 6/1986 | Lewis | 346/1.1 |
| 4,609,924 | 9/1986 | De Young | 346/1.1 |
| 4,682,185 | 7/1987 | Martner | 346/140 |
| 4,682,187 | 7/1987 | Martner | 346/140 |
| 4,714,936 | 12/1987 | Helinski et al. | 346/140 R |
| 4,739,339 | 4/1988 | DeYoung et al. | 346/1.1 |
| 4,814,786 | 3/1989 | Hoisington et al. | 346/1.1 |
| 4,823,146 | 4/1989 | Cooke et al. | 347/88 X |
| 4,864,330 | 9/1989 | Creagh et al. | 346/140 |
| 4,870,430 | 9/1989 | Daggett et al. | 346/140 |
| 5,038,157 | 8/1991 | Howard et al. | 346/140 |
| 5,172,135 | 12/1992 | Creagh et al. | 346/1.1 |
| 5,223,860 | 6/1993 | Loofbourow et al. | 346/140 R |

FOREIGN PATENT DOCUMENTS

| | | | |
|---|---|---|---|
| 0178886 | 10/1989 | European Pat. Off. | B41J 3/04 |
| 8808514 | 3/1988 | WIPO | G01D 15/16 |
| 8902575 | 9/1988 | WIPO | G01D 15/16 |

OTHER PUBLICATIONS

Howtek Inc., Howtek Pixelmaster User's Guide ver. 1.1 pp. 14, 15 (May 1988, Milford, N.H.).

Tektronix Inc., 4696 Color Ink-Jet Printer Users Manual second printing pp. B3, B4 (Feb. 1987, Beaverton, Oreg.).

*Primary Examiner*—Benjamin R. Fuller
*Assistant Examiner*—Alrick Bobb
*Attorney, Agent, or Firm*—Ralph D'Alessandro

[57] ABSTRACT

A triggerable ink transfer system that simultaneously transfers ink from a plurality of ink preload chambers to corresponding load chambers and ink reservoirs is disclosed. The delivery system permits an untrained operator to safely load ink without inadvertently interchanging different types (e.g. colors) of ink, and without inadvertently overfilling any of the ink reservoirs. A processing unit that coordinates ink delivery system monitoring and control features is in communication with an operator interface unit that provides ink loading instructions to the operator.

15 Claims, 15 Drawing Sheets

STANDARD INK LOAD FUNCTIONS
FROM FIG.11(a)
TURN OFF SOLENOID JOG HEAD
UPDATE LEVEL TO FILL
START MELT TIMER
INK LEVEL FULL ?
NO
MELT TIMER AT 6 MIN ?
NO
YES
YES
LEVEL SENSE READING

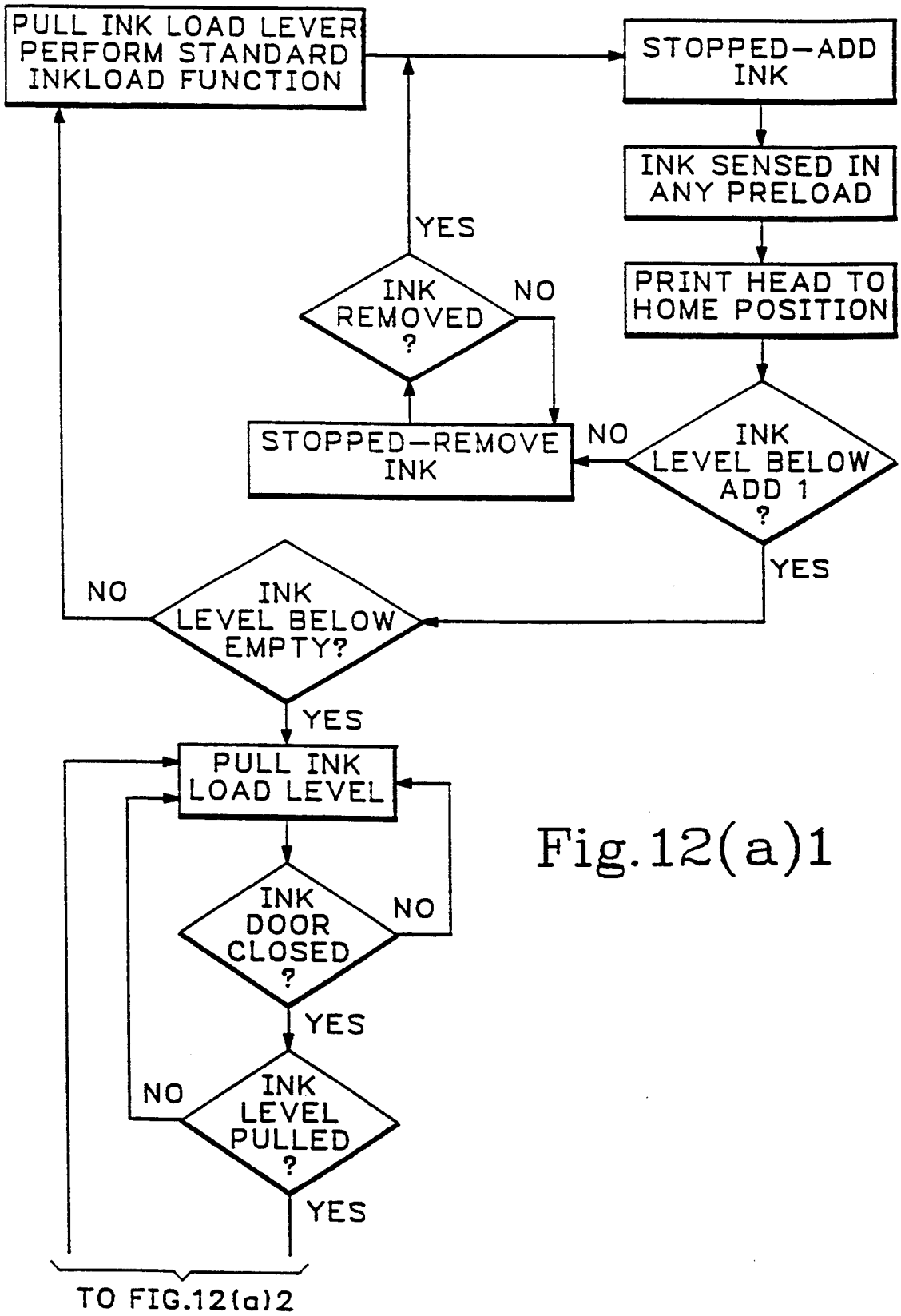
Fig.12(a)1

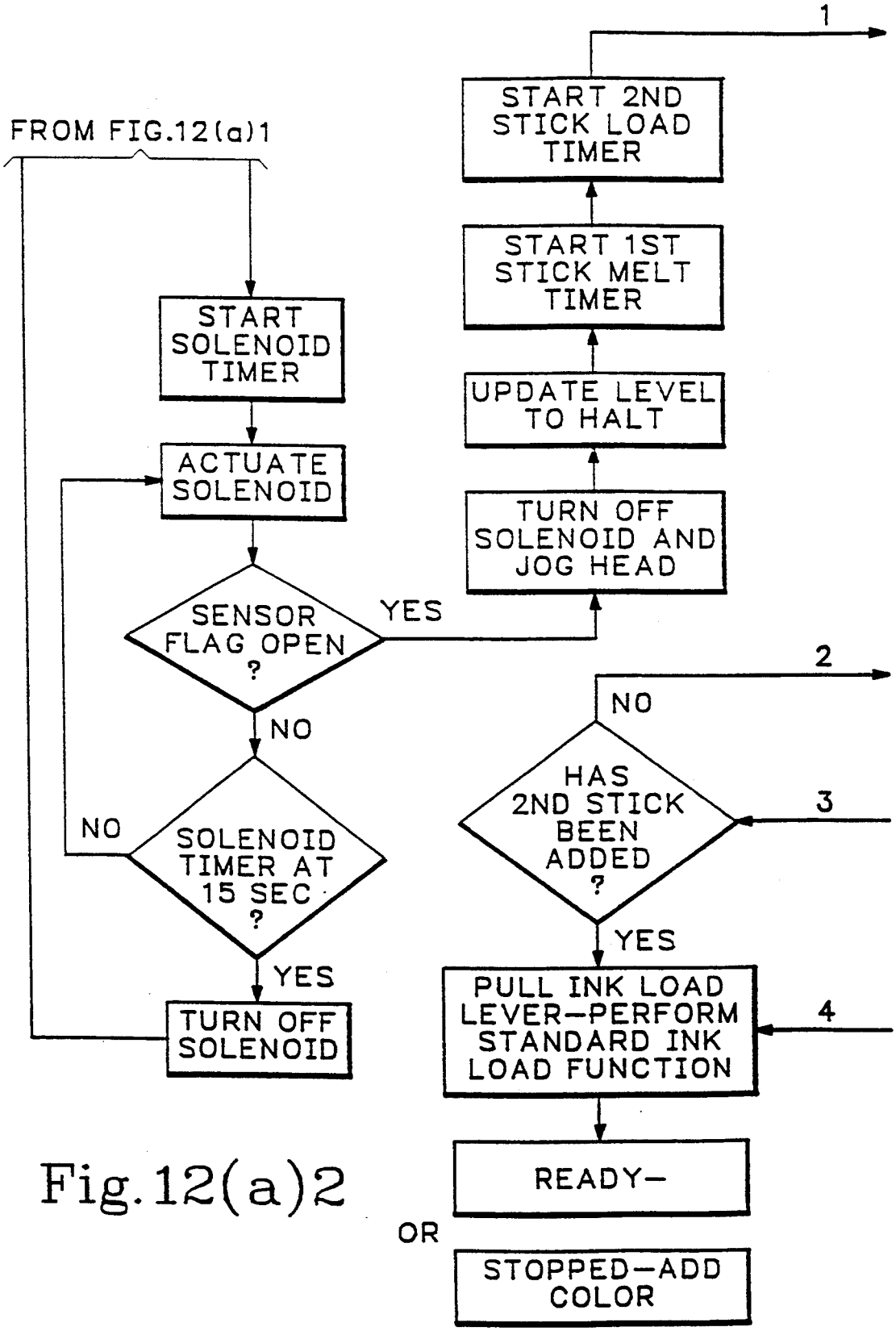
Fig. 12(a)2

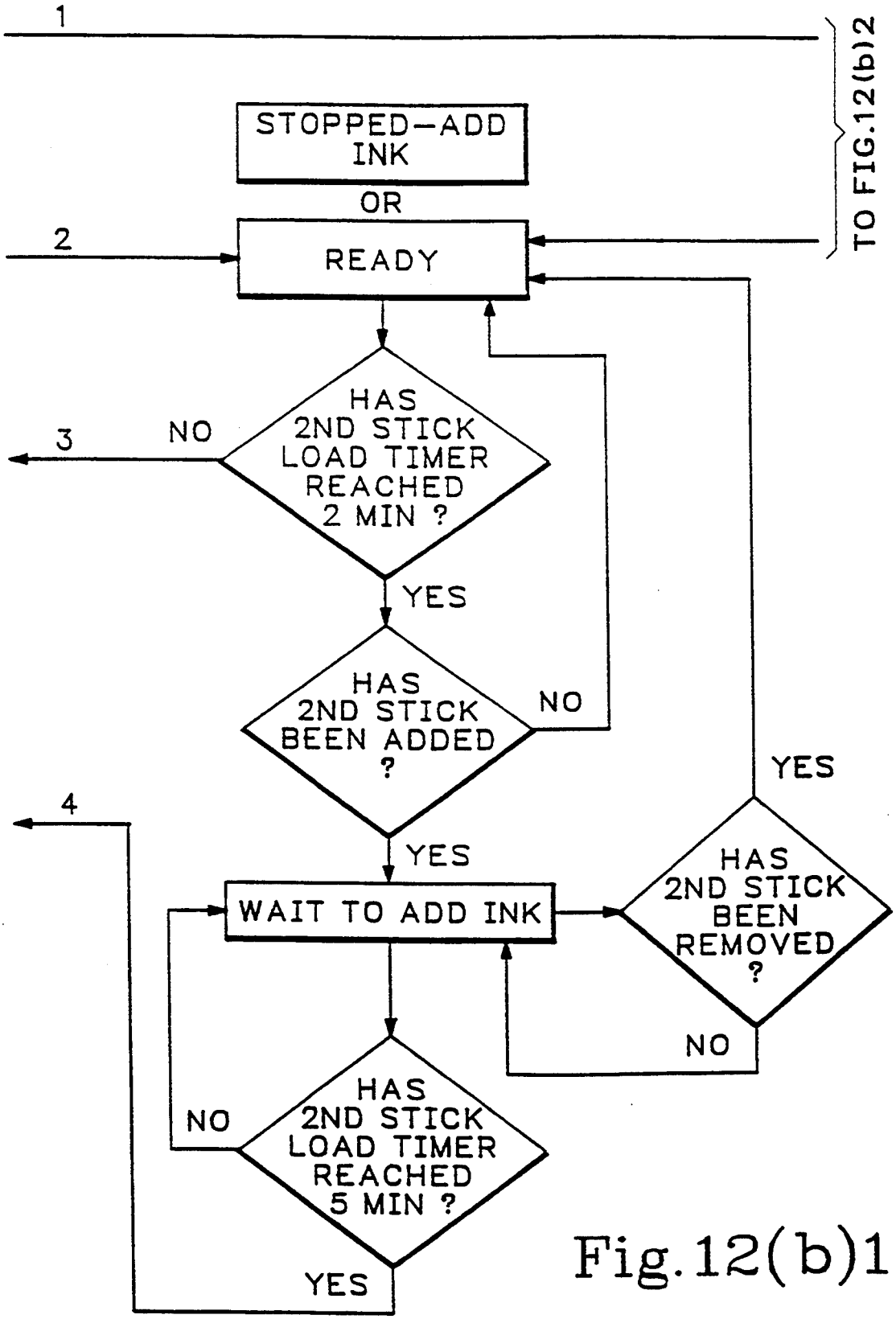
Fig. 12(b)1

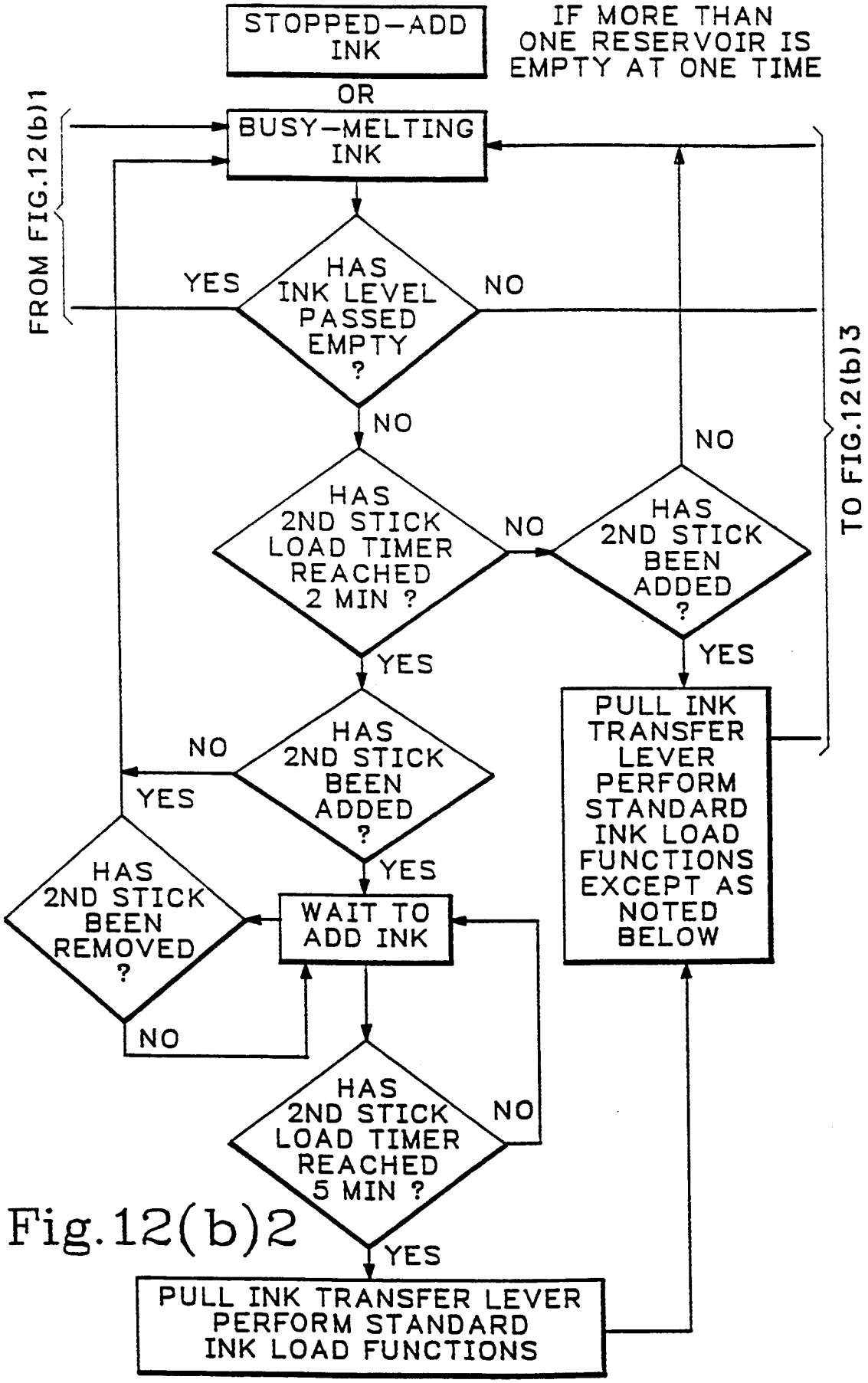
Fig.12(b)2

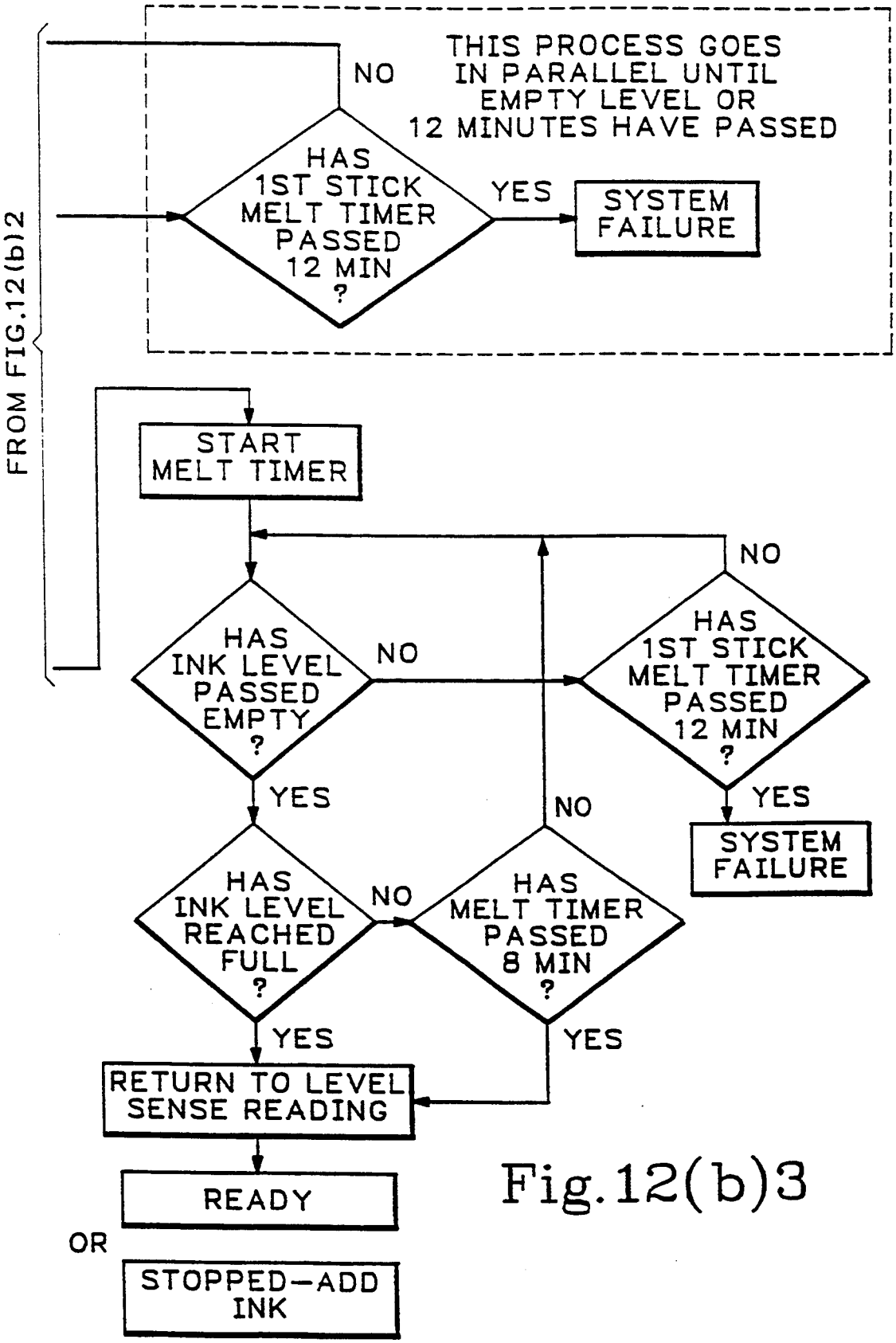
Fig.12(b)3

APPARATUS FOR SUPPLYING PHASE CHANGE INK TO AN INK JET PRINTER

This is a continuation of application Ser. No. 07/716,567, filed Jun. 17, 1991, U.S. Pat. No. 5,223,860, issued Jun. 9, 1993.

TECHNICAL FIELD

The present invention relates to methods and apparatus for providing a substantially continuous supply of phase change ink to an ink jet print head.

BACKGROUND OF THE INVENTION

Ink jet printers operate by ejecting ink onto a print substrate, such as paper, in controlled patterns of closely spaced dots. By selectively regulating the pattern of ink droplets, such ink jet printers can be used to produce a wide variety of printed materials, including text, graphics, images, and the like. Moreover, ink jet printers are capable of recording permanent images on a wide variety of substrates, including both light reflective and light transmissive substrates.

Ink jet printers typically utilize a variety of inks, including phase change inks, which are often referred to as hot melt inks. Phase change inks are solid at ambient temperatures and liquid at the elevated operating temperatures of an ink jet printing device. Liquid phase ink jet droplets are ejected from the printing device at an elevated operating temperature and, when the ink droplets contact the surface of a substrate, they rapidly solidify to form the predetermined pattern.

Phase change ink is advantageous for printing purposes for a variety of reasons. Problems associated with nozzle clogging due to ink evaporation are largely eliminated, thereby improving the reliability of ink jet printing. Because the ink droplets solidify rapidly upon contact with the substrate, migration of ink along the printing medium is greatly reduced and image quality is improved. The nature and rapid solidification of phase change inks moreover permits high quality images to be printed on a wide variety of printing substrates.

Early references to phase change inks for ink jet printing involved monochrome inks jetted by electrostatic printing devices. Thus, for example, U.S. Pat. No. 3,653,932 discloses a low melting point (30° C. to 50° C.) ink having a base comprising di-esters of sebacic acid. In a similar process, U.S. Pat. No. 3,715,219 describes low melting point (30° C. to 60° C.) inks including a paraffin alcohol-based ink. One disadvantage of printing with low melting point phase change inks is that they frequently exhibit offset problems. Specifically, when substrates printed with these inks are stacked and stored for subsequent use, the ink adheres to adjacent surfaces, particularly if the printed substrates are exposed to high ambient temperatures.

U.S. Pat. Nos. 4,390,369 and 4,484,948 describe methods for producing monochrome phase change inks that employ a natural wax ink base, such as Japan wax, candelilla wax, and carnauba wax, which are subsequently printed from a drop-on-demand ink jet device at a temperature ranging between 65° C. and 75° C. U.S. Pat. No. 4,659,383 discloses a monochrome ink composition having an ink base including a C20–24 acid or alcohol, a ketone, and an acrylic resin plasticizer. These monochrome ink compositions are not durable and, when printed, may become smudged upon routine handling and folding.

Japanese Patent Application No. 128,053/78 discloses the use of aliphatic and aromatic amides that are solid at room temperature, such as acetamide, as printing inks. U.S. Pat. No. 4,684,956 is directed to monochrome phase change inks utilizing synthetic microcrystalline wax (hydrocarbon wax) and microcrystalline polyethylene wax. This molten composition can be applied to a variety of porous and non-porous substrates using drop-on-demand ink jet application techniques.

Many ink jet printers are capable of discharging multiple ink colors and providing high quality color images. Color ink jet printers typically utilize three base color inks, in addition to black, that are blended together to print a large spectrum of intermediate colors. European Patent Application Nos. 0187352 and 0206286 disclose phase change ink jet printing in color. The ink bases for these systems include fatty acids, a thermoplastic polyethylene and a phase change material in the first application; and the alcohol portion of a thermosetting resin pair, a mixture of organic solvents (o- and p-toluene sulfonamide) and a dye in the second application. Moreover, the development of phase change inks that are substantially transparent provides improved capability to print images on many types of substrates, including light transmissive substrates. Phase change ink compositions disclosed in U.S. Pat. No. 4,899,761 are exemplary.

Phase change ink is conveniently stored, transported, and introduced into an ink jet printer assembly in a solid form. Prior to printing, the ink is heated to a suitable liquid phase temperature. During printer operation, liquid phase ink is supplied to the print head at the proper temperature for ejection. Color ink jet printers use at least one reservoir corresponding to each such color and separate ink jets are in communication with each reservoir for printing the various ink colors. An important consideration in the design of phase change ink jet printers is providing a substantially continuous supply of liquid ink at the ink jet print head from solid ink supply means.

Controlling the supply of phase change ink to the print head is difficult, in part because it requires moderately frequent operator assistance. It would be desirable to provide a phase change ink delivery system requiring minimal operator intervention. Moreover, it is imperative that the correct ink color is provided to each such reservoir and the associated jets. This requires alert operator handling as well as reliable mechanical registration systems to assure that appropriate ink colors remain segregated.

The chemistry of phase change inks also poses challenges to providing a continual supply of phase change ink in the liquid state. It is generally undesirable to heat a large supply of phase change ink or to maintain phase change ink in a liquid state for extended periods of time because extended "cooking" of such inks frequently results in degradation of the ink. Heating of phase change inks is therefore carefully regulated and ink is typically permitted to cool and solidify when the printer is shut off or has been inactive for a predetermined period of time.

Many different arrangements have been devised for supplying phase change ink in a solid form and melting it to supply print head ink reservoirs. For example, U.S. Pat. No. 4,682,185 teaches a spooled, flexible web of hot melt ink that is incrementally unwound and advanced to a heater location. U.S. Pat. No. 4,682,187 teaches delivery of particulate hot melt ink to a melt chamber. Vibration aids gravity feeding of the particulate ink, and the melted ink level, as measured by a float valve, governs introduction of additional ink particulates to the melt chamber.

Several arrangements have been developed in an effort to provide phase change ink delivery systems that reduce operator handling of ink and yet provide a continual supply of ink, in solid form, to the ink reservoir. U.S. Pat. No. 4,609,924 teaches a solid state ink storage means and buffer reservoir that are fixed relative to the ink reservoir located in the scanning print head. The buffer reservoir provides melted ink to the scanning print head on a standby basis.

U.S. Pat. No. 4,870,430 teaches a solid ink delivery system that selectively supplies individual sticks of solid ink to a hot melt ink jet printer head for melting and subsequent printing. Separate ink delivery systems, including separately triggerable ink stick feed assemblies, are provided for each color ink stick delivered to the hot melt ink jet printer. A positioning assembly is provided for aligning the reservoir openings in the print head with the corresponding ink stick feed assemblies. Each ink delivery system furthermore has a registration assembly that prevents triggering of the feed assembly unless the appropriate reservoir opening is properly aligned.

PCT International Publication No. WO 88/08514 teaches a hot melt ink supply system for an ink jet apparatus adapted for use with multiple pigmented inks. Ink is maintained in a liquid condition in two reservoirs: one reservoir is in communication with the ink jet head; and another is a remote supply reservoir. The two liquid ink reservoirs communicate through a flexible supply conduit in which ink is normally maintained in a solid condition. When low ink levels at the print head require transfer of ink, the supply conduit is heated to melt the ink in the conduit and a pump is actuated to transfer ink in a liquid condition. Heaters may be arranged in the ink supply system to maintain thermal gradients and produce convective circulation of molten ink to prevent ink pigments from settling.

PCT International Publication No. WO 89/02575 teaches a hot melt ink supply unit that utilizes a different keyed configuration for each ink color. Ink reservoirs may be formed for each ink color having correspondingly keyed configurations to prevent the possibility of supplying ink of the wrong color to a reservoir reserved for a specific ink color. Solid ink blocks and corresponding reservoirs are configured so that ink blocks having a specific configuration can be received only in reservoirs having that configuration.

European Patent Publication No. 0178886 teaches a solid state ink delivery system wherein solid state ink is stored at a fixed location. A movable imaging head has at least one ink jet and an associated reservoir and may be aligned with the solid ink storage reservoir for transferring ink. Ink transfer is accomplished by melting the ink to a liquid state and permitting it to flow into the imaging head reservoir.

U.S. Pat. No. 4,490,731 teaches an ink dispensing system for a thermal ink jet printer wherein a resistance heating wire traverses the solid ink reservoir and a supply tube connecting the solid ink reservoir with the ink head reservoir. Melted ink is transported through the supply tube by capillary action.

Prior art phase change ink delivery systems, in general, have failed to provide the desired substantially continuous ink flow with a minimum of operator handling requirements and mechanical failures. Ink delivery systems for supplying solid sticks of phase change ink, such as that taught in U.S. Pat. No. 4,870,430, described above, are typically complex and require frequent and alert operator intervention. The ink delivery system of the present invention was therefore designed to provide a substantially continuous supply of different types (e.g., colors) of phase change ink to corresponding print head reservoirs while requiring minimal operator handling and reducing the risks of mechanical failure and operator error.

SUMMARY OF THE INVENTION

The phase change ink delivery system of the present invention provides a substantially continuous supply of ink to a print head for printing. The delivery system permits an untrained operator to safely load ink without inadvertently interchanging different types (e.g. colors) of ink, and without inadvertently overfilling any of the ink reservoirs. A single triggerable ink transfer system simultaneously transfers ink from a plurality of preload chambers to the corresponding load chambers and ink reservoirs.

The ink delivery system also includes a processing unit in communication with an operator interface unit that provides ink loading instructions to the operator. The processing unit is in communication with sensors that monitor ink loading conditions and ink levels in the print head ink reservoirs and preload chambers. Preferred systems for operating the monitoring and control features of the processing unit are also disclosed.

BRIEF DESCRIPTION OF THE DRAWINGS

The above-mentioned and additional features of the present invention and the manner of obtaining them will become apparent, and the invention will be best understood by reference to the following more detailed description, read in conjunction with the accompanying drawings, in which:

FIGS. 12(*a*)1, 12(*a*)2, 12(*b*)1, 12(*b*)2 and 12(*b*)3 show a detailed flow diagram illustrating a preferred embodiment of the monitoring and control functions of the ink delivery system of the present invention from an "empty" condition wherein at least one ink reservoir is empty.

DETAILED DESCRIPTION OF PREFERRED EMBODIMENTS

The ink delivery system of the present invention is adapted for use with an ink jet printing device utilizing a plurality of inks having different characteristics. The system is described with reference to a plurality of inks having different color characteristics, but the ink delivery system of the present invention would be suitable for use with inks having other distinctive properties as well.

Figure 1:
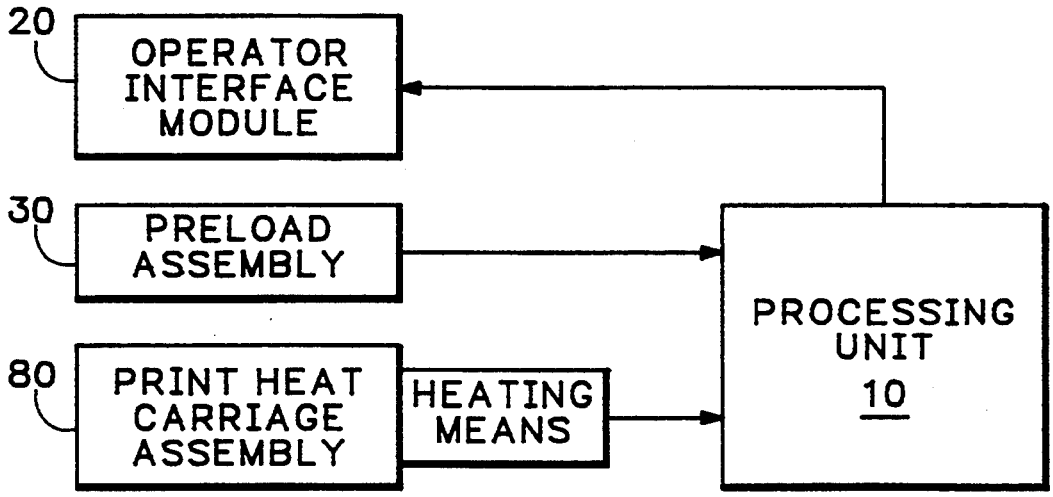
FIG. 1 shows a highly schematic diagram of a processing unit, operator interface module, and ink preload and print head assemblies of the present invention.

FIG. 1 shows a highly schematic diagram of an ink delivery system of the present invention wherein sensors for detecting various ink loading and ink level conditions at an ink delivery preload assembly 30 and a print head carriage assembly 80 are in communication with processing unit 10. Processing unit 10 receives sensed information from ink delivery preload assembly 30 and print head carriage assembly 80 and, in accordance with the sensed information, provides information and operator instructions to operator interface module 20.

A detailed description of the logic involved in monitoring and controlling ink levels in preload assembly 30 and carriage assembly 80 and providing instructions to operator interface module 20 is provided below. Generally speaking, processing unit 10 receives and stores information regarding the presence or absence of solid ink sticks in each preload chamber; the level of ink in specific print head ink reservoirs; the position of the ink transfer lever; actuation of the solenoid; and alignment of print head carriage assembly 80 with preload assembly 30. Based upon this information, instructions are conveyed from processing unit 10 to the user interface module 20 to instruct an operator regarding specific ink loading requirements.

The monitoring and control functions are preferably implemented by microprocessor-based electronics and may be incorporated in the electronics of the print engine board. Additionally, some processing functions may be incorporated in operator interface module 20. For example, operator interface module 20 may be used for input of printer maintenance commands, such as "CLEAN (PRINT) HEAD" and "TEST PRINT."Additionally, operator interface module 20 may provide storage of all of the user messages and translations of the messages in a variety of languages. It may also control the state of one or more LED's indicating, for example, "POWER," "ERROR," or the like .

Figure 2:
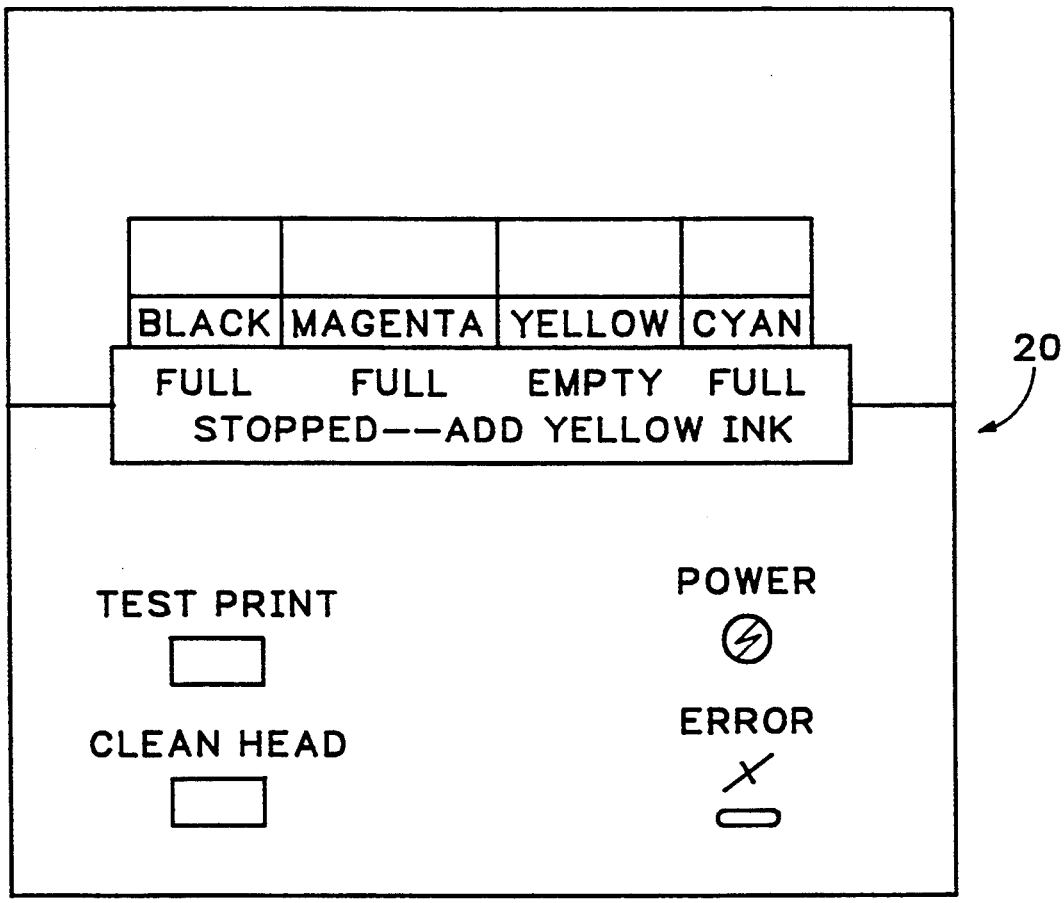
FIG. 2 shows a top view of a user interface module displaying exemplary ink reservoir level information and an exemplary operator instruction.

FIG. 2 illustrates operator interface module 20 showing an exemplary level of information and instruction. A color-coded ink level display is provided for each ink color utilized—e.g,. black, magenta, yellow and cyan. Ink levels are typically displayed in one of three categories: "FULL" indicating the ink reservoir level is satisfactory; "HALF FULL" indicating one ink stick may be added; and "EMPTY," indicating that at least one ink stick must be added. Additionally, specific operator instructions are displayed—e.g. "STOPPED—ADD YELLOW INK"—that prompt an operator to perform specific tasks.

Mechanical aspects of the ink delivery system, including carriage assembly 80 and preload assembly 30, are illustrated in FIGS. 3–10. Print head carriage assembly 80 and ink delivery preload assembly 30 are preferably separate and independent units. Preload assembly 30 is stationary with respect to print head carriage assembly 80 and is permanently mounted in the ink jet printer. Phase change ink is introduced as a solid phase ink stick to preload assembly 30 and is maintained in the solid phase in preload assembly 30. Solid ink sticks are transferable from preload assembly 30 to print head carriage assembly 80, where they are melted prior to and during printing operations. Print head carriage assembly 80 is alignable with ink preload assembly 30 during transfer of solid ink sticks and ink transfer cannot take place until proper alignment of the print head carriage assembly has been confirmed. The printing substrate and print head carriage assembly 80 are typically reciprocated relative to one another during printing operations as liquid phase ink is ejected from the print head carriage assembly.

Figure 3:
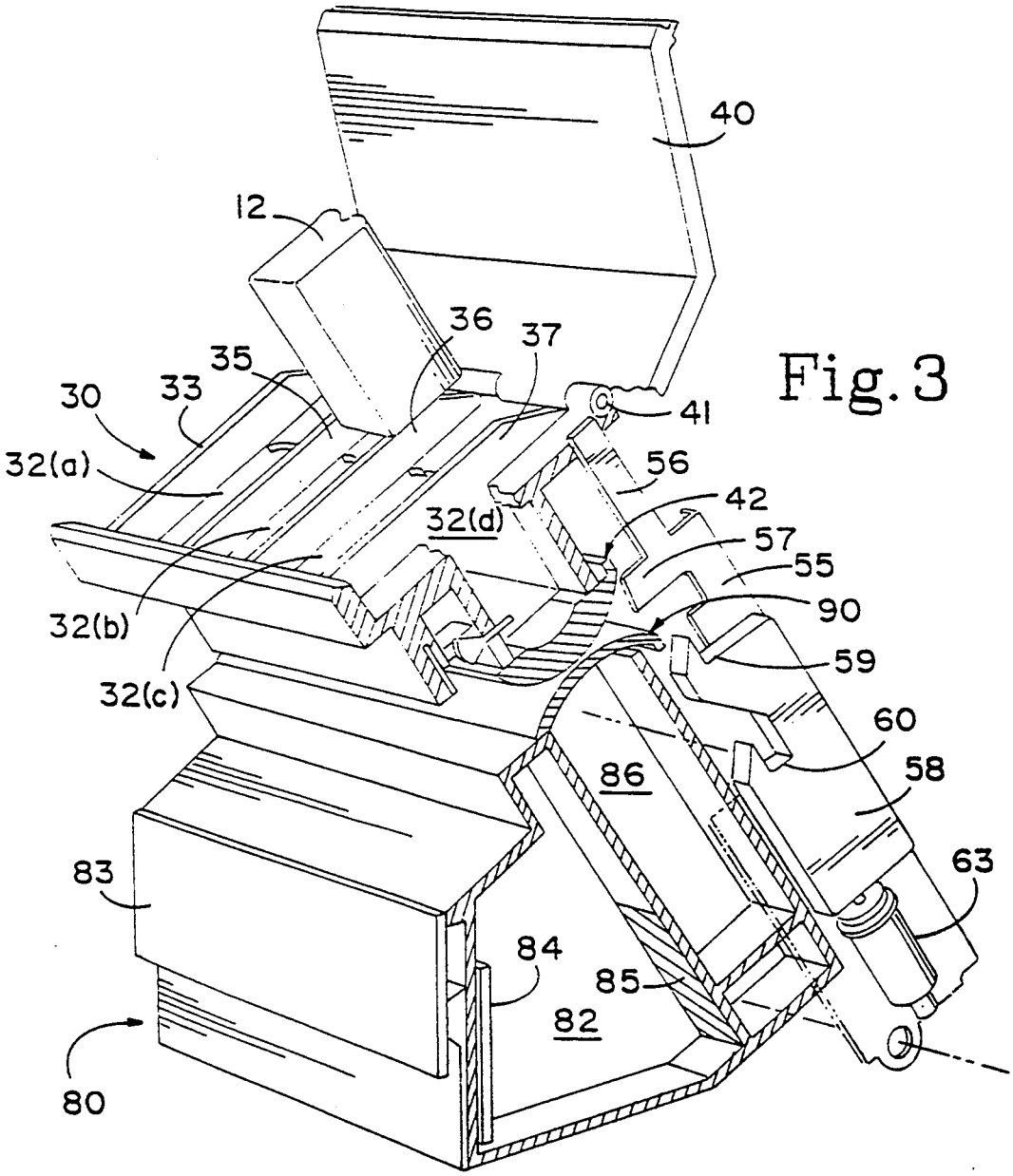
FIG. 3 shows an isometric, partially cross-sectional view of a print head carriage assembly aligned with an ink delivery preload assembly in an ink transfer condition.

As illustrated in FIG. 3, ink preload assembly 30 has a plurality of ink preload chambers 32. The ink delivery system illustrated and described herein is intended for use with four ink colors, and four ink preload chambers 32(*a*)–(*d*) are consequently provided. Each preload chamber 32(*a*)–(*d*) is physically separated from the other ink preload chambers and is reserved for use with a specific ink color. The chambers are preferably generally rectangular and, according to preferred embodiments, each preload chamber 32 is adapted to accommodate a single stick of solid phase ink. Ink preload chambers are defined by end walls 33 and 34 and partitions 35, 36 and 37.

The ink delivery system of the present invention utilizes solid phase ink sticks having a different configuration assigned to each ink color. Ink preload chambers 32(*a*)–(*d*) are correspondingly keyed for specific ink stick configurations. This is conveniently accomplished by mounting an aperture plate 38 at an upper end of ink preload assembly 30. Aperture plate 38 is provided with a series of apertures, shown as 39(*a*)–(*d*), in FIG. 4, each having a different configuration. Each of the aperture configurations is mutually non-exclusive—that is, each aperture can accommodate ink sticks of only one configuration. This feature assures that appropriate ink sticks are insertable only in the corresponding preload chambers and prevents an operator from inadvertently inserting ink sticks into the wrong preload chamber.

Aperture plate 38 is preferably mounted in ink preload assembly 30 such that standard ink sticks project from the surface of aperture plate 38 when inserted in the corresponding preload chambers. This feature permits manual removal of an ink stick from a preload chamber if the ink stick was loaded prematurely or in error. As shown in FIG. 3, end wall 33 and partitions 35–37 project above aperture plate 38 to maintain the separation between adjacent preload chambers.

Figure 4:
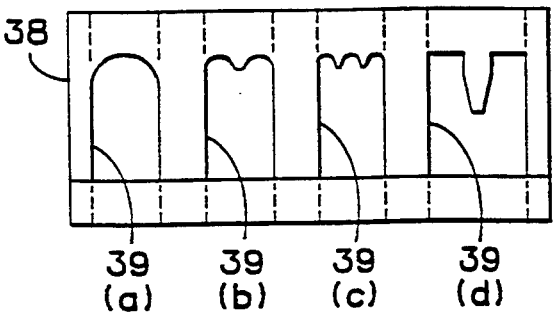
FIG. 4 shows a top view of an aperture plate for use in the preload assembly providing different configurations corresponding to specific ink colors.

As shown in FIGS. 3 and 4, aperture 39(*d*) and the corresponding preload chamber 32(*d*) are larger than their counterparts. Because black is typically the most commonly used ink, a larger ink reservoir may be provided. The solid ink preload chamber and aperture provided for black ink are therefore sized to accommodate larger ink sticks and thereby provide a continuous supply of ink to the corresponding ink reservoir.

Ink preload chambers 32(*a*)–(*d*) are coverable at both ends. An operator access end of preload chambers 32(*a*)–(*d*) is coverable by a cover plate 40 that extends substantially the width of preload assembly 30. Cover plate 40 is pivotable about pivot pin(s) 41 and is rotatable to permit insertion of solid ink sticks into the corresponding ink preload chambers. Cover plate 40 is preferably spring loaded toward a closed position so that it is automatically maintained in a closed condition except when pivoted by an operator to insert ink into the preload chamber(s). Cover plate 40 is also interlocked to preclude ink transfer from a preload chamber to a load chamber or ink reservoir when the cover plate is opened. This feature protects the operator from hazards such as ink splashes.

Ink sticks 12 are retained in ink preload chambers 32(*a*)–(*d*) by means of a movable preload door 42 positionable beneath ink preload chambers 32(*a*)–(*d*). Preload door 42 includes two end walls 43, one of which is visible in FIGS. 5–10. Opposite preload door end walls 43 are mounted for pivotal movement on end walls 33 and 34 of preload chambers 32(*a*) and 32(*d*) at pivot point 44. An arcuate bottom wall 45 extends between the end walls 43 substantially the width of preload assembly 30 and, when in a closed position, retains ink sticks in chambers 32(*a*)–(*d*). Pin 46 projects from preload door end wall 43 and is instrumental during adjustment of preload door 42 between closed and ink transfer positions. Upon rotation of preload door 42, ink sticks are transferred by gravity from one or more preload chambers 32(*a*)–(*d*) to adjacent load chambers in print head carriage assembly 80.

Print head carriage assembly 80 includes ink reservoirs 82(*a*)–(*d*) corresponding to each ink color and arranged in a fashion corresponding to the arrangement of preload chambers 32(*a*)–(*d*). During printing operations, ink is maintained in a liquid condition in ink reservoirs 82(*a*)–(*d*) to provide a continuous supply of ink to print heads mounted on exposed face 83 of print head carriage assembly 80. Ink level sensing means 84 are provided in each ink reservoir 82 to continuously monitor ink levels and convey information concerning operating ink levels to processing unit 10.

In addition to ink reservoirs 82(*a*)–(*d*), print head carriage assembly 80 includes ink load chambers 86(*a*)–(*d*) that serve as ink storage and melting chambers intermediate ink preload chambers 32 and corresponding ink reservoirs 82. A filter 85 separates ink load chambers 86 from respective ink reservoirs 82 and serves to filter the melted ink before it is deposited in ink reservoirs 82. Each ink load chamber 86 has a cross-sectional configuration at least generally coextensive with that of the corresponding ink preload chamber 32. Ink load chambers 86 may, however, be sized to accommodate more than one stick of ink in an end-to-end arrangement.

Ink load chambers 86(*a*)–(*d*) are in communication with corresponding ink reservoirs 82(*a*)–(*d*), such as via filter 85, and provide liquid ink to the corresponding ink reservoir. Heaters are typically provided in ink load chambers 86 that are activated to melt ink in the load chambers in response to the presence of solid ink in the load chambers subsequent to their having been loaded from pre-load chambers 32(*a*)–(*d*).

Ink load chambers 86 and ink preload chambers 32 are preferably aligned on a plane that is disposed at an angle with respect to exposed face 83, which forms the mounting plane for the ink jet print heads. Ink jet print heads are conventionally arranged to eject ink droplets in a generally horizontal direction and exposed face 83 is thus oriented generally vertically. Arrangement of ink preload assembly 30 and ink load chambers 86 in a canted orientation, as shown, enhances visibility and accessibility of preload assembly 30 to operators and facilitates user interface during the insertion or removal of ink sticks. It moreover facilitates the flow of liquid ink between ink load chambers 86 and corresponding ink reservoirs 82 and provides a more compact assembly. The angled orientation of ink preload assembly 30 and ink load chambers 86 also provides a continually dry contact surface for solid ink sticks during loading and thereby reduces the likelihood of melted ink splashing during solid ink loading.

Ink load chambers 86 are coverable by means of a movable load door 90. Load door 90 is preferably similar in design to preload door 42 and extends at least substantially the width of carriage assembly 80. Load door 90 includes two end walls 91, one of which is visible in FIGS. 5–10. End walls 91 are pivotally mounted to end walls of ink load chambers 86 at pivot point 92. An arcuate load door bottom wall 93 extends between end walls 91. Pin 94 projects from load door end wall 91 and is instrumental during adjustment of preload door 42 between closed and ink transfer positions. Upon rotation of load door 90 about pivot point 92, ink load chambers 86 are exposed to permit transfer of ink sticks by gravity from the corresponding preload chambers. Load door 90 is preferably spring biased toward the closed position, so that it is automatically returned to the closed position unless it is held open.

Figure 5:
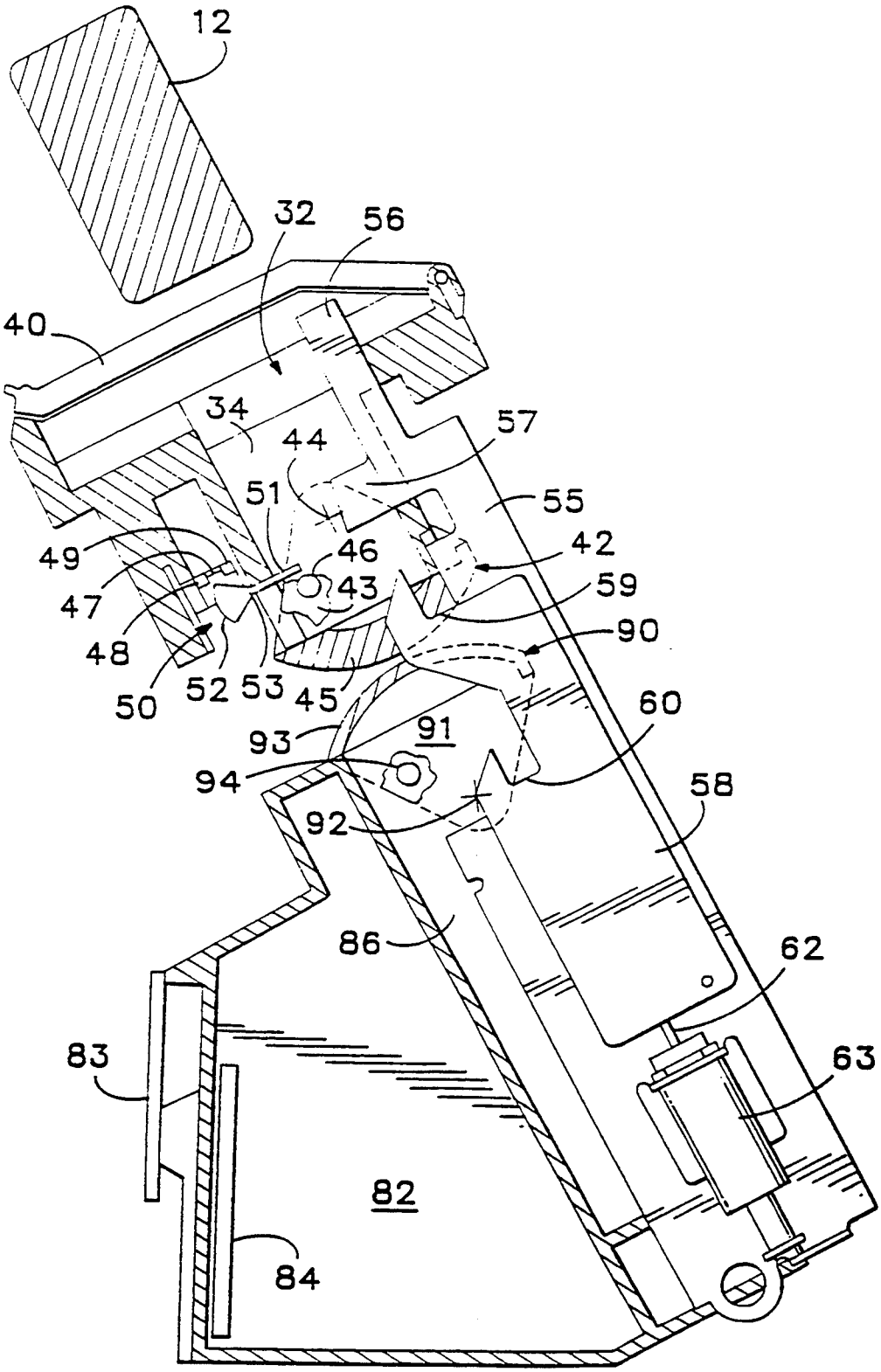
FIG. 5 shows a side view of an ink delivery system including a print head carriage assembly aligned with a preload assembly in an unloaded condition.

Each ink preload chamber 32 is provided with an ink sensing device. The embodiment illustrated in FIGS. 5–10 employs an optical sensing means, but other types of sensors, such as microswitches and the like, are well known and would be suitable. The optical sensor preferably comprises means for propagating an optical beam 47, such as an LED (light emitting diode) 48, with a photoresistor 49 mounted opposite the beam and capable of detecting the beam. The position of a sensor flag 50 with respect to the optical sensor signals the presence or absence of an ink stick in ink preload chambers 32. Optical beam 47 emitted by LED 48 is uninterrupted and detected by photoresistor 49 when the ink preload chamber is empty, as shown in FIG. 5.

Sensor flag 50 has a projecting portion 51 that projects into the corresponding ink preload chamber 32 when ink is not present in the preload chamber. Sensor tripping portion 52 is disposed on the opposite side of sensor flag 50. Flag 50 is pivotally mounted intermediate the projecting and sensor tripping portions at pivot point 53. Upon insertion of ink stick 12 into preload chamber 32, sensor flag 50 is rotated and optical beam 47 is blocked by sensor tripping portion 52. Ink stick sensing devices in each ink preload chamber convey signals to processing unit 10 indicating the presence or absence of an ink stick in each preload chamber.

Figure 7:
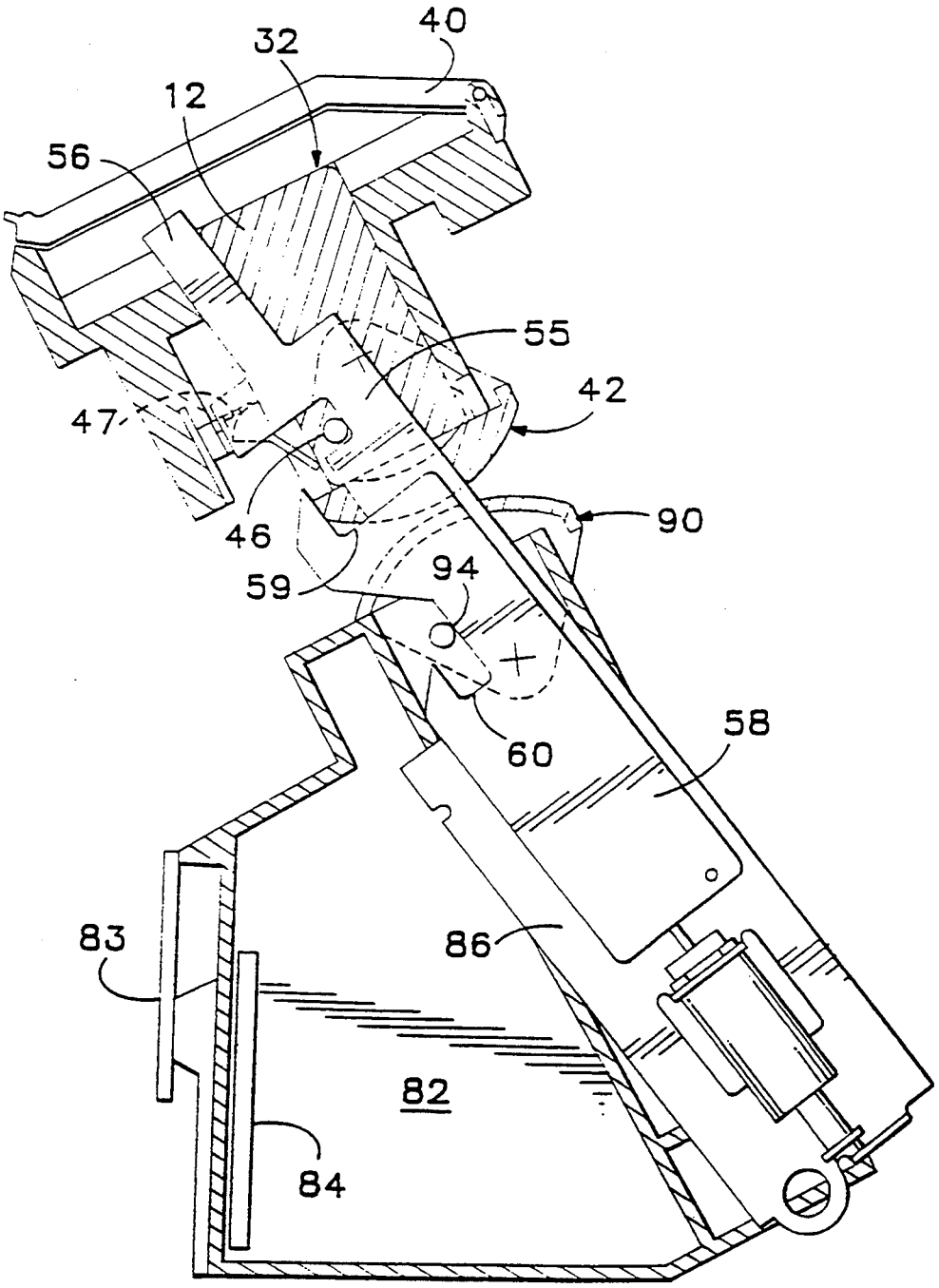
FIG. 7 shows a side view of the ink delivery system of FIG. 5 with the ink load lever displaced in a preload position.
Figure 8:
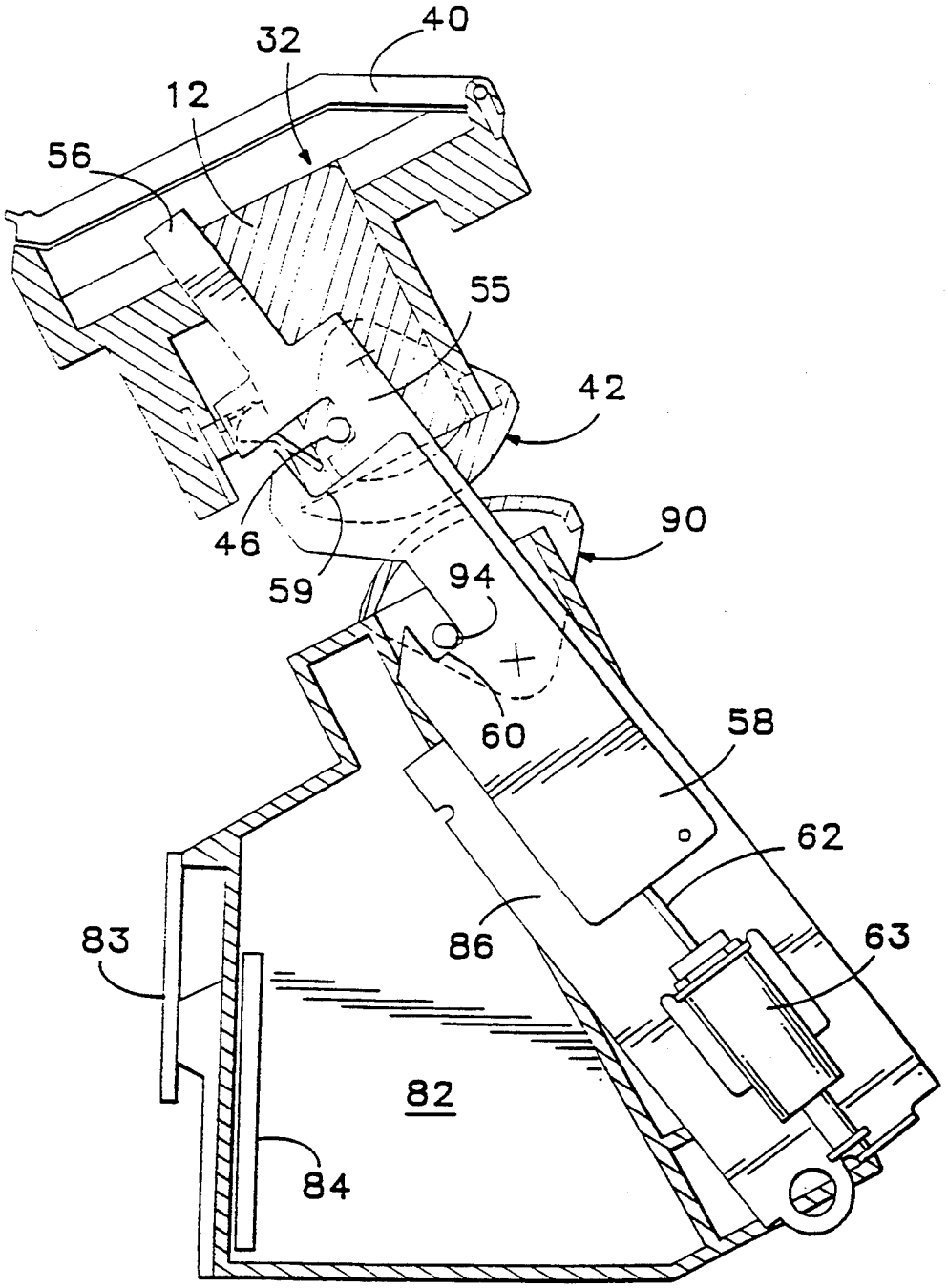
FIG. 8 shows a side view of the ink delivery system of FIG. 5 with the ink load slide in an ink load position.

Preload assembly 30 additionally includes an ink transfer lever 55 pivotally mounted to an extending side wall of ink preload assembly 30. Ink transfer lever 55 is movable between a rest position, as shown in FIGS. 5 and 6, and an ink preload position, as shown in FIGS. 7 and 8. Ink transfer lever 55 includes a handle 56 that projects sufficiently above ink preload chambers 32 to be accessible to an operator during ink transfer operations and a projection 57 that provides a detection surface to indicate when ink transfer lever 55 is in an ink preload position.

Ink transfer slide 58 is mounted in slidable relationship with respect to lever 55. Ink transfer slide 58 includes first and second detents 59 and 60, respectively, that are engageable with pins 46 and 94, respectively, provided on end walls of preload and load doors 42 and 90, respectively. Ink transfer slide 58 is mounted on an actuatable push rod 62. Push rod 62, and hence ink transfer slide 58, are preferably slidable upon activation of solenoid 63.

FIG. 5 shows the print head carriage assembly and the ink preload assembly aligned in an ink transfer position wherein carriage assembly 80 is aligned underneath preload assembly 30 and corresponding preload and load chambers are in registration. Sensors are provided to detect alignment and communicate with processing unit 10. Suitable sensing means for performing this function are well known in the art. Ink transfer operations cannot be accomplished unless the carriage and preload assemblies are in alignment. Preload and load doors 42 and 90, respectively, are in a closed position.

The operator is prompted by an ink level reading of "HALF FULL" or by an ink level reading of "EMPTY" and a specific instruction on operator interface module 20 to add ink to appropriate preload chambers. "HALF FULL" ink levels indicate that there is sufficient space in ink reservoir 82 to accommodate one additional solid ink stick and the appropriate solid ink stick would therefore be accepted. When any ink reservoir attains an "EMPTY" level, printing operations cease, and carriage assembly 80 is automatically aligned with preload assembly 30 in an ink transfer position. Printing operations will not resume until the required ink has been inserted in a preload chamber and transferred to the corresponding load chamber.

Carriage assembly 80 is also automatically aligned with preload assembly 30 in an ink transfer position upon detection of a solid ink stick in any preload chamber 32. Ink transfer operations are therefore commenced by alignment of carriage assembly 80 with preload assembly 30 as the result of an "EMPTY" ink level reading or upon insertion of an ink stick in a preload chamber in response to a "HALF FULL" ink level reading.

Figure 6:
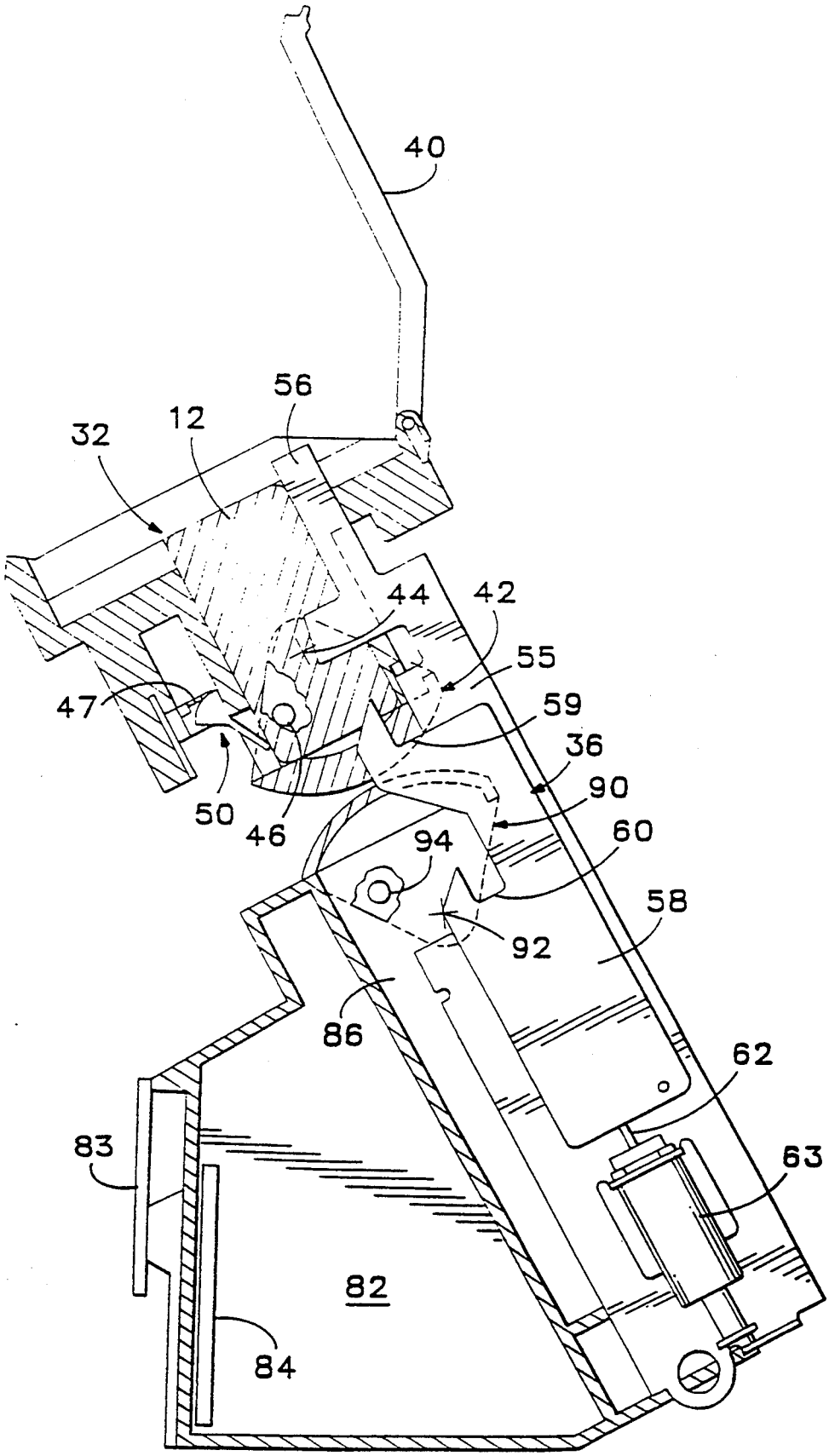
FIG. 6 shows a side view of the ink delivery system of FIG. 5 with an ink stick loaded in the preload chamber.

Ink loading operations can be initiated upon alignment of carriage assembly 80 with preload assembly 30. As shown in FIG. 6, cover plate 40 is pivoted about pivot pin(s) 41 to provide access to ink preload chambers 32. At this stage, an operator may insert appropriate ink sticks 12 into appropriate ink chambers in response to the instructions and/or ink level readings provided at user interface module 20. While cover plate 40 is open, power to solenoid 63 is grounded to prevent slide 58 from being moved. This is accomplished by means of a Hall-Effect switch arranged in series with solenoid 63.

Upon insertion of an ink stick 12 into the corresponding preload chamber 32, sensor flag 50 obstructs the path of optical beam 47 and an ink detection signal is conveyed to processing unit 10. Processing unit 10 confirms that ink reservoir 82 corresponding to the loaded preload chamber 32 has a "HALF FULL" or "EMPTY" ink level reading and therefore can accept loaded ink, and that the carriage and preload assemblies are in alignment. If the first condition is not satisfied—that is, if ink has been loaded in an inappropriate preload chamber, processing unit 10 conveys a message to operator interface unit 20 instructing the operator to remove the inappropriately loaded ink stick. The ink loading operation will not progress and the printer will not resume operation until the improperly loaded ink stick has been removed.

Once processing unit 10 detects that ink stick(s) 12 have been inserted into appropriate preload chamber(s) 32 and the carriage and preload assemblies are aligned, it conveys a message to operator interface module 20 instructing the operator to pull ink transfer lever 55. The operator pulls lever 55 forward in response to this instruction and thereby locates lever 55 in an ink preload position, as shown in FIG. 7. In the ink preload position, lever detents 59 and 60 are positioned underneath and in registration with projecting pins 46 and 94, respectively, on ink preload and load chamber doors 42 and 90, respectively.

Another sensor detects when lever 55 is located in the ink transfer position and conveys a corresponding message to processing unit 10. An optical sensor is preferably employed that detects tab 57 on ink transfer lever 55 to monitor the position of the ink transfer lever. Provided that the ink transfer conditions described above have been satisfied, processing unit 10 activates solenoid 63 and thereby displaces ink transfer slide 58 to an ink transfer position. Actuation of solenoid 63 displaces push rod 62 and ink transfer slide 58 and causes detents 59 and 60 to engage projecting pins 46 and 94 respectively, as shown in FIG. 8. If processing unit 10 determines requisite ink transfer conditions have not been satisfied, it will not actuate solenoid 63 and ink transfer slide 58 will not be displaced to an ink transfer position.

Figure 9:
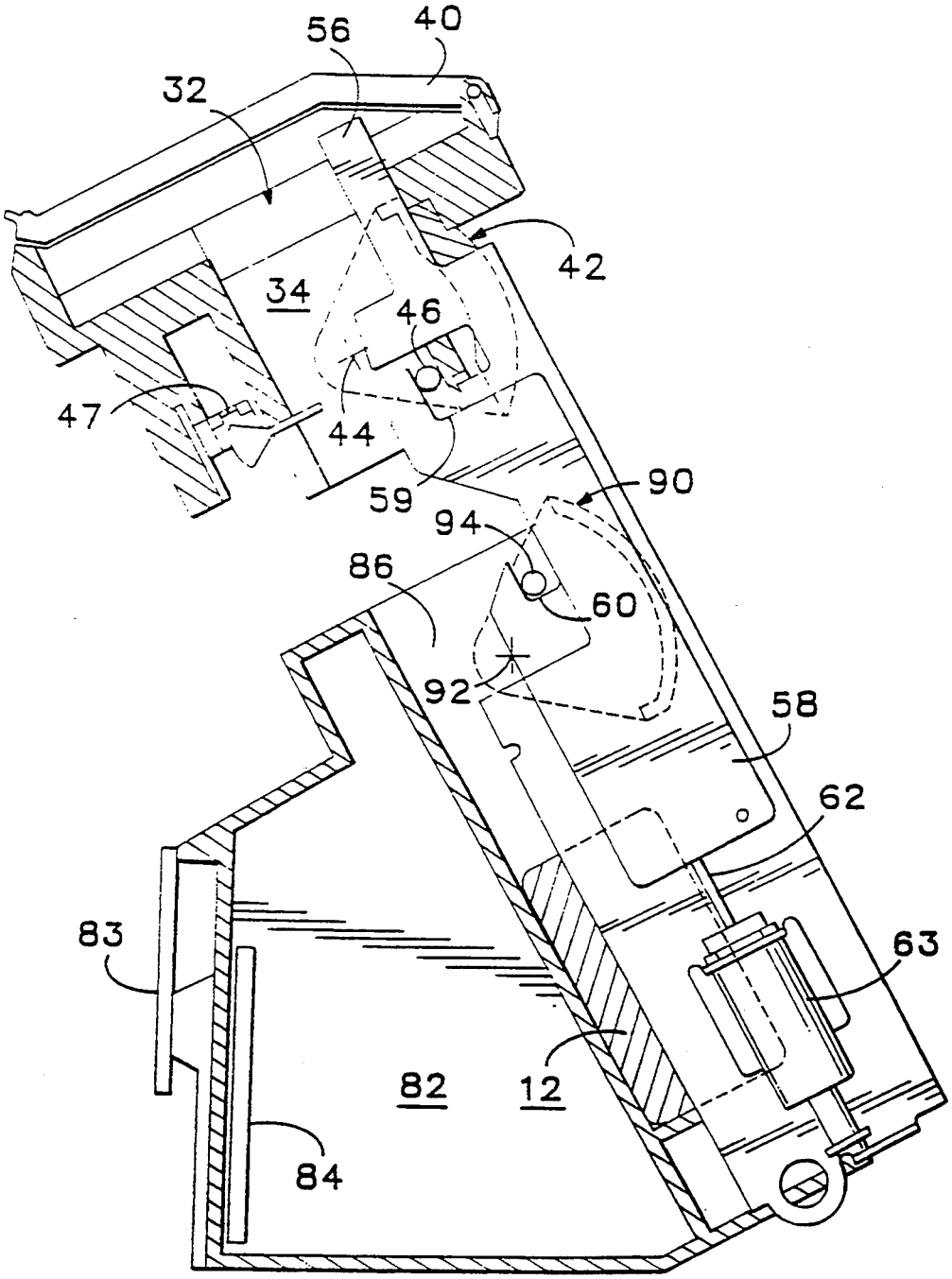
FIG. 9 shows a side view of the ink delivery system of FIG. 5 in an ink transfer condition during transfer of a solid ink stick from a preload chamber to the print head ink load chamber.
Figure 10:
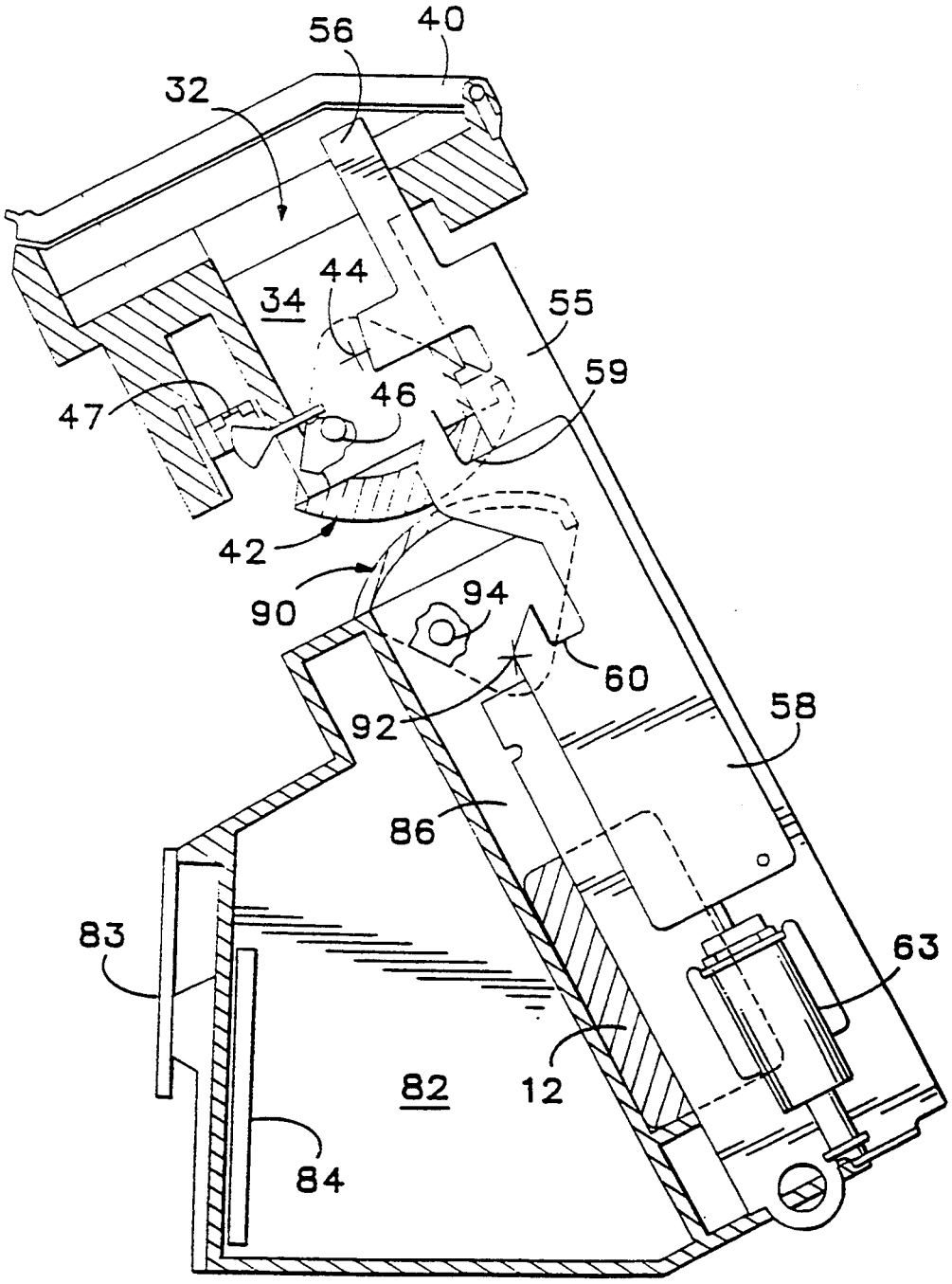
FIG. 10 shows a side view of the ink delivery system of FIG. 5 in a rest position after transfer of a solid ink stick to the print head ink load chamber.

Upon release of ink load lever 55, it is returned to its rest position by spring biasing means, or the like. Detents 59 and 60 displace pins 46 and 94 respectively, and thereby cause simultaneous rotation of preload and load doors 42 and 90, respectively, in opposite directions, as shown in FIG. 9. While both the preload and load doors 42 and 90, respectively, are open, ink sticks 12 are transferred, via gravity, from preload chamber(s) 32 to corresponding load chamber(s) 86.

After a predetermined time interval, or upon receipt of a signal from the ink preload detection sensor(s), solenoid 63 is deactivated and ink transfer slide 58 is returned to its rest position. Upon displacement of slide 58, projecting pins 46 and 94 are released from detents 59 and 60, respectively, and the preload and load chamber doors, respectively, are returned to their closed, non-transfer positions illustrated in FIG. 10. Solid ink stick 12 is positioned in load chamber 86 and is therein melted to supply ink to the corresponding ink reservoir 82 during printing operations.

The ink delivery system of the present invention thus utilizes a single, triggerable ink transfer system that simultaneously transfers solid ink sticks from one or more preload chambers to corresponding load chambers and ink reservoirs. The mechanical and logical simplicity of the system contributes to system reliability and acceptance and facilitates operator handling aspects of ink delivery. The integrated ink delivery system of the present invention is capable of providing a substantially continuous ink supply to print head ink reservoirs while reducing the risks of mechanical failure and operator mishandling.

Figure 11A:
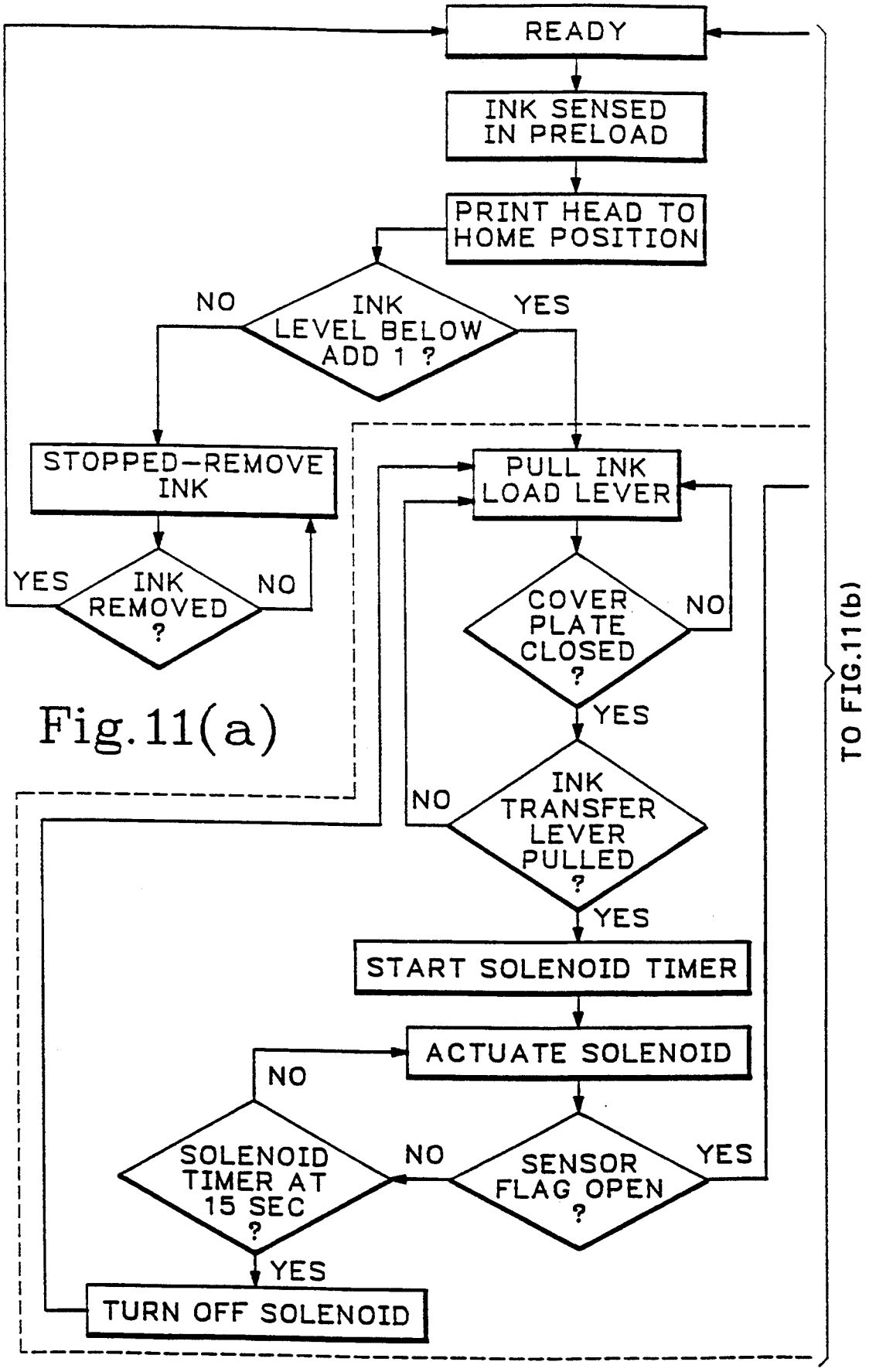
FIGS. 11(*a*) and 11(*b*) shows a detailed flow diagram illustrating a preferred embodiment of the monitoring and control functions of the ink delivery system of the present invention from a "READY" condition wherein at least one of the ink reservoirs can accept an ink stick and none of the ink reservoirs is less than half full.
Figure 11B:
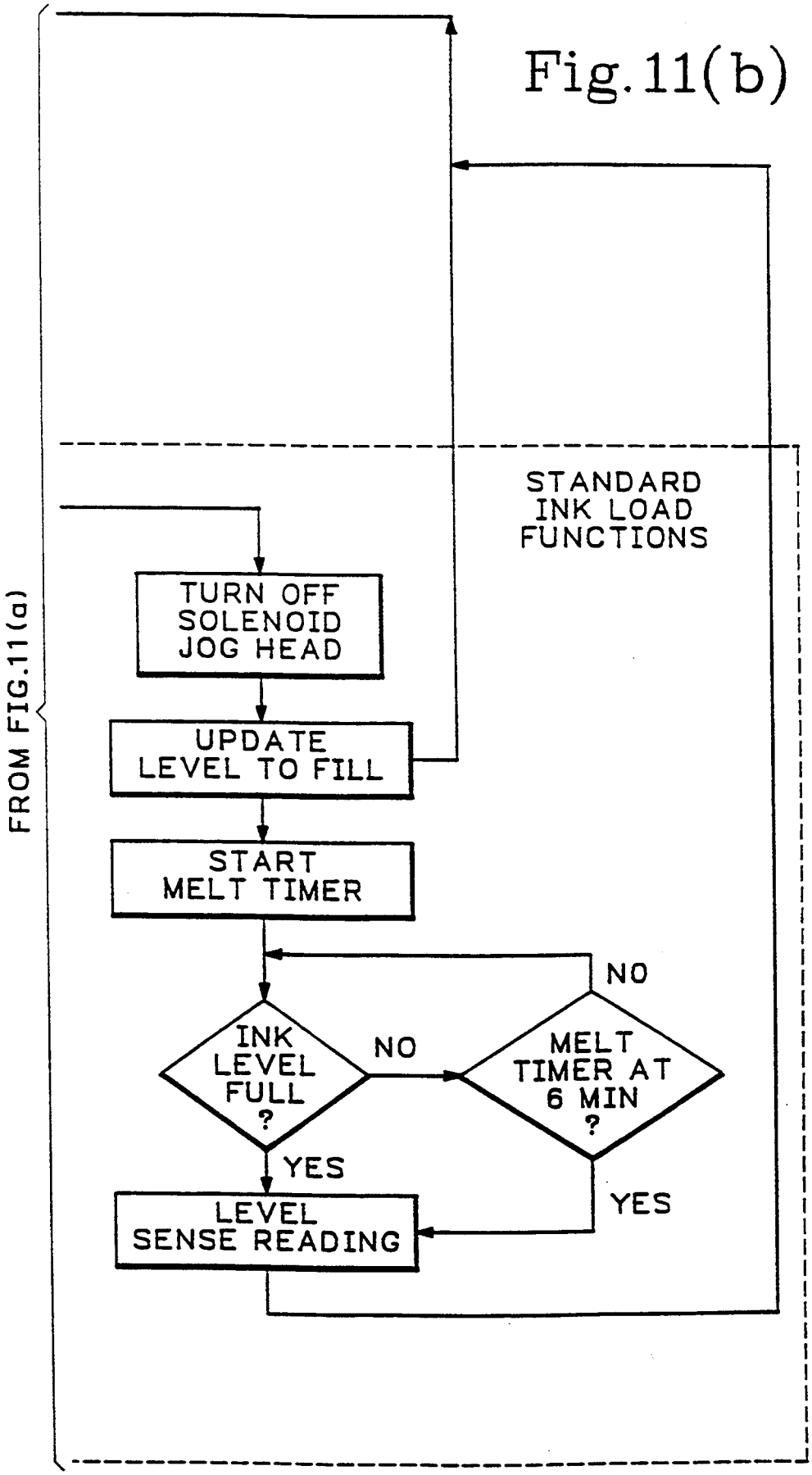

FIGS. 11(*a*) and 11(*b*) illustrates the monitoring and control functions of a preferred embodiment of the ink delivery system of the present invention from a "READY" condition wherein at least one of the ink reservoirs is "HALF FULL" (i.e., it can accept an ink stick), and none of the ink reservoirs is in an empty condition. Commands that appear on the operator interface module are shown in highlighted boxes. The ink delivery system is in a "READY" condition after an operator has inserted a solid ink stick into a preload chamber in response to an operator command or a "HALF FULL" ink level indication. Sensors detect when an ink stick has been positioned in a selected preload chamber, and print head carriage assembly 80 is moved to the home position aligned with preload assembly 30.

After the print head carriage assembly 80 and preload assembly 30 are in registration, the monitoring and control system confirms that the ink level in the appropriate ink reservoir is such that the ink reservoir can accept an ink stick. If the ink reservoir corresponding to the solid ink stick inserted in the preload chamber cannot accept an additional ink stick, a command appears on operator interface module 20 alerting the operator to remove the ink stick from the preload chamber. This situation indicates that an ink stick was inserted in the wrong preload chamber, and the system returns to the "READY" condition after the ink stick is removed.

When a solid ink stick is inserted in a preload chamber corresponding to an ink reservoir that can accept additional ink, a "PULL INK TRANSFER LEVER" command appears on the operator interface module. After the system verifies that the cover plate is closed and the ink transfer lever has been pulled, a solenoid timer is started and the solenoid is actuated to transfer the ink stick from the preload to the corresponding load chamber. Ink levels are updated, ink melting apparatus is actuated, and the ink load system is returned to a "READY" condition. Ink transfer functions shown in the dashed box of FIG. 11 are referred to herein as Standard Ink Transfer Functions.

FIGS. 12(*a*)1, 12(*a*)2, 12(*b*)1, 12(*b*)2 and 12(*b*)3, in combination, illustrate the monitoring and control functions of a preferred embodiment of the ink delivery system of the present invention from an "EMPTY" condition of at least one ink reservoir. In the illustrated configuration, an empty ink reservoir is capable of accepting two ink sticks, and two ink sticks may be introduced sequentially to the appropriate ink preload chamber. When an ink reservoir is in an "EMPTY" condition, the printer is stopped and print head carriage assembly 80 is aligned with preload assembly 30 for ink transfer.

After the system has verified that the ink reservoir corresponding to the solid ink stick inserted in the preload chamber can accept additional ink, the system detects whether the ink level is below empty. If the ink level is not below empty, i.e., the ink reservoir can accept one ink stick, the "PULL INK TRANSFER LEVER" command is given and the Standard Ink Transfer Functions are repeated. If the ink level is below empty, the "PULL INK TRANSFER LEVER" command is given and ink transfer functions proceed. After a first ink stick melt timer and a second ink stick load timer have been started, the operator interface module displays a "BUSY—MELTING INK" or "STOPPED—ADD INK" command.

Once the ink level has passed the empty condition, the system is returned to a "READY" condition and a second ink stick may be added, as described above. If the ink level does not exceed "EMPTY" after a predetermined time interval has elapsed, the control system indicates a system failure and printing operations cannot resume until the system failure has been corrected.

While in the foregoing specification, this invention has been described in relation to certain preferred embodiments thereof, and many details have been set forth for purposes of illustration, it will be apparent to those skilled in the art that the invention is susceptible to additional embodiments and that certain of the details described herein may be varied considerably without departing from the basic principles of the invention.

We claim:

1. An ink transfer system comprising:

a plurality of ink preload chambers, each one of the plurality of ink preload chambers being adapted to receive a solid phase ink stick and maintain the ink stick in the solid phase;

a plurality of ink reservoirs maintaining ink in a melted condition during operation of a printing apparatus, each one of the plurality of ink reservoirs corresponding to one of the plurality of ink preload chambers, and each one of the plurality of ink reservoirs furtherbeing in communication with a corresponding ink preload chamber;

means for detecting when a solid phase ink stick is positioned in an ink preload chamber;

a triggerable ink transfer means capable of maintaining solid phase ink sticks in each of the plurality of ink preload chambers in a non-transfer condition and to transfer solid phase ink sticks located in each of the plurality of ink preload chambers to a corresponding ink reservoir in a transfer condition;

a plurality of solid phase ink sticks, each of the solid phase ink sticks having a different cross-sectional polygon shape; and a plurality of openings to the ink preload chambers shaped such that a corresponding one of the cross-sectional polygon shaped solid phase ink sticks will pass through a corresponding one of the openings to the ink preload chambers, but will not pass through any other of the plurality of openings to the ink preload chambers.

2. The system according to claim 1, wherein the shape of each one of the plurality of openings and each one of the plurality of solid phase ink sticks is elongated and generally rectangular, each ink stick further having six facing surfaces, at least one of the facing surfaces being non-planar and of a different shape than a corresponding facing surface of the remaining other plurality of sticks of solid phase ink of different color.

3. The system according to claim 2, further comprising each stick of solid phase ink having a top surface, a bottom surface, two opposing side surfaces interconnecting the top surface and the bottom surface and two opposing end surfaces interconnecting the two opposing side surfaces and the top surface and the bottom surface.

4. The system according to claim 3 further comprising each top surface having different configurations.

5. The system according to claim 4, further comprising the top surface being one selected from the group consisting of rounded, single notched, double notched, and single deep grooved configurations.

6. An ink load system according to claim 1 wherein the plurality of ink preload chambers are covered with a cover, further wherein the cover is interlocked to preclude ink transfer from the plurality of ink preload chambers to the corresponding ink reservoirs when the cover is open to prevent ink splashes.

7. An ink load system according to claim 6, wherein the plurality of ink preload chambers are separated from the plurality of ink reservoirs by a filter means for filtering the melted ink of any impurities.

8. The system according to claim 3 wherein each top surface for each of the plurality of blocks of hot melt ink have a different configuration.

9. The system according to claim 8 further comprising the top surface being one selected from the group consisting of rounded, single notched, double notched, and single deep grooved configurations.

10. A hot melt ink system comprising heating means for melting the hot melt ink, a plurality of reservoirs for hot melt ink of different colors connected to the heating means to retain the ink in a melted state, each one of the plurality of reservoirs being connected to a corresponding plurality of ink receiving means for receiving the hot melt ink, detection means for detecting a presence of at least one solid block of hot melt ink in each one of the ink receiving means, the ink receiving means having an opening with a generally polygonal configuration for each one of the plurality of reservoirs, the configuration of each opening being different for each one of the reservoirs, and a plurality of blocks of hot melt ink of different colors having different generally polygonal elongated peripheral configurations, each block of hot melt ink further being of a different configuration than the remaining other plurality of blocks of hot melt ink such that the plurality of blocks of hot melt ink are arranged to be received only in a corresponding one of the openings in the ink receiving means to prevent ink of the wrong color from being supplied to a reservoir.

11. The system according to claim 10 further comprising each block of hot melt ink having a top surface, a bottom surface, two opposing side surfaces interconnecting the top surface and the bottom surface and two opposing end surfaces interconnecting the two opposing side surfaces and the top surface and the bottom surface.

12. The system according to claim 10 wherein the plurality of hot melt ink blocks each having a different polygon shape, and wherein the plurality of openings to the ink receiving means are shaped such that a corresponding one of the polygon shaped hot melt ink blocks will pass through a corresponding one of the openings to the ink receiving means, but will not pass through any other of the plurality of openings to the ink receiving means.

13. The system according to claim 12 wherein one of the plurality of openings and the corresponding hot melt ink block are larger in size than the remaining plurality of openings and hot melt ink blocks.

14. The system according to claim 13 wherein the ink receiving means comprises an aperture plate covering the ink receiving means, and wherein the aperture plate has a plurality of openings corresponding to the shapes of the plurality of hot melt ink blocks.

15. The system according to claim 10 wherein an operator interface indicates the absence of blocks of hot melt ink in any of the plurality of ink receiving means.

* * * * *